United States Patent [19]

Rosier

[11] Patent Number: 4,813,261

[45] Date of Patent: Mar. 21, 1989

[54] ROTATABLE OFFSET NOSE ASSEMBLY FOR SETTING FASTENERS

[75] Inventor: Hendrik E. Rosier, Kingston, N.Y.

[73] Assignee: Huck Manufacturing Company, Irvine, Calif.

[21] Appl. No.: 163,042

[22] Filed: Mar. 2, 1988

[51] Int. Cl.[4] ..... B21J 15/20; B21D 31/00

[52] U.S. Cl. ..... 72/391; 72/453.17

[58] Field of Search ..... 72/391, 453.17, 453.19, 72/114; 29/243.53

[56] References Cited

U.S. PATENT DOCUMENTS

| | | | |
|---|---|---|---|
| 2,170,323 | 8/1939 | Gorshkoff | 72/391 |
| 3,157,305 | 11/1964 | Baugh | 72/391 |
| 3,605,478 | 9/1971 | Chirco | 72/391 |
| 3,665,581 | 5/1972 | Gulistan | 72/391 |
| 3,713,321 | 1/1973 | La Pointe | 72/391 |
| 3,774,437 | 11/1973 | Young | 72/391 |
| 4,368,631 | 1/1983 | Tanikana | 72/391 |
| 4,615,206 | 10/1986 | Rosier | 72/391 |
| 4,649,732 | 3/1987 | Molina | 72/391 |

*Primary Examiner*—David Jones

*Attorney, Agent, or Firm*—Lawrence J. Shurupoff; Robert F. Hess

[57] ABSTRACT

An offset nose assembly for swaging a fastener collar about a fastener pin includes an anvil housing which is rotatably mounted within a tubular sleeve portion of a hydraulically actuated installation tool. A collet is slidably fitted within the anvil housing and is connected to a piston of the installation tool via a smooth-walled drawbar and tubular adapter coupling. The drawbar is received within smooth-walled bores formed within the collet and the tubular adapter coupling. The tubular adapter coupling is closely fitted within a tubular portion of the anvil housing and is adapted to be securely fixed to the reciprocating piston of an installation tool. The anvil housing is mounted to the installation tool with a split ring and fastening nut in a manner which ensures an axial clearance is maintained between the installation tool and the anvil housing thereby providing free rotational movement of the anvil housing around the tool.

6 Claims, 5 Drawing Sheets

ROTATABLE OFFSET NOSE ASSEMBLY FOR SETTING FASTENERS

REFERENCE TO RELATED APPLICATION

Attention is directed to copending application Ser. No. 029,935, filed Mar. 24, 1987 entitled COMPACT OFFSET NOSE ASSEMBLY FOR SETTING FASTENERS, assigned to the same assignee as the present application and incorporated herein by reference.

BACKGROUND OF THE INVENTION

1. Field of the Invention

This invention relates generally to tools for setting fasteners having pin members with pull grooves and more particularly concerns a rotatable nose assembly for lockbolt installation tools. The nose assembly is designed to minimize deflection between a collet and anvil during swaging of a collar about a pin member and to minimize operator fatigue by facilitating the positioning of the nose assembly about a lockbolt.

2. Description of Prior Developments

A demand has arisen for an ergonometrically designed installation tool for setting fasteners of the lockbolt type. A tool is required which can access and install lockbolt fasteners located between closely spaced panels or within a small clearance space. To satisfy this demand, various attempts have been made to provide an offset nose assembly including an anvil and collet for swaging a fastener collar about a grooved fastener pin. In various prior designs, the axis of the swaging anvil has been radially offset from the axis of the piston which drives the anvil against the collar. This arrangement allows the radially offset anvil portion of the nose assembly to access and set fasteners without interference from the anvil housing and/or from the body of the installation tool.

By offsetting the axis of the fastener pin and collar assembly from the axis of the tool piston, large bending forces are generated within the nose assembly during swaging of the collar around the pin. These bending forces have heretofore resulted in deflection between the anvil and collet as well as deflection of the entire nose assembly with respect to the body of the installation tool and with respect to the pin and collar. This deflection, which arises primarily from assembly tolerances and loose fit threaded joints, results in the application of a radial force to the pin and has causes radial deflection of the pin during setting of the fastener.

Such radial deflection, when transmitted and applied to the fastener pin, has caused premature and/or uncontrolled pin breakage resulting in defective connections between the pin and collar. This problem is particularly acute when titanium alloyed pins are used since these pins are most sensitive to radial loading and will easily shear under such radially applied loads before the collar is fully set.

Another problem caused by the deflection between the anvil and collet is the rapid wear between these moving parts. Wear can become particularly acute between threaded joints. As the parts wear, they lose their ability to properly set the collar about the pin. Conventional nose assemblies often wear out prematurely thereby necessitating replacement of the worn parts at relatively frequent intervals. This further reduces productivity and incurs significant replacement costs.

To prevent these undesirable results, prior designs have attempted to resist the deflection of offset nose assemblies by increasing the size and mass of the anvil housing, the collet and the threaded collet stud which connects the collet to the tool. These massive and bulky assemblies thus attempted to provide the necessary rigidity within the nose assembly per se. While such designs have generally performed satisfactorily, they have not been able to access extremely close or cramped installation sites due to their relatively large and massive construction. That is, in order to stiffen the nose assembly, prior anvil housings and collets have been designed with thick cross sections thereby resulting in relatively bulky and wide contours incapable of reaching within small spaces.

Even with an offset nose assembly, certain installation sites necessitate awkward and uncomfortable tool manipulations in order to access and set the lockbolt fasteners. Because installation tools can weigh from 8 to 15 pounds and must be hand operated in cramped locations, an operator can quickly experience muscle fatigue. This fatigue results in lower production rates and promotes defective lockbolt joints since a fatigued operator is prone to misalign the tool during setting of the fastener.

In some cases, an installation site is so inaccessible that the use of pin and collar lockbolts is precluded because the lockbolt installation tools cannot access the installation site. The conventional solution to this problem is to install threaded fasteners of the nut and bolt variety with a hand tool such as a wrench or the like. This approach is not only time consuming and expensive, it is also inefficient as retorquing is often necessary after installation.

Accordingly, a need exists for an ergonometrically designed durable rotatable offset nose assembly which resists deflection and wear under load, prevents undesirable pin deflection, avoids premature and/or uncontrolled pin failure and allows access of the nose assembly within tight or cramped spaces without causing operator fatigue.

SUMMARY OF THE INVENTION

The present invention has been developed to solve the problems noted above and therefore has as a primary object the provision of a durable rotatable offset nose assembly which resists deflection and wear during tool actuation yet which defines a relatively compact profile for accessing limited spaces while minimizing operator fatigue.

Another object of the invention is to avoid the radial loading of threaded joints formed between nose assembly components and between the tool and the nose assembly by providing non-threaded radial support via smooth surfaced interfitted components.

Radial loading of the fastener pin is minimized by carefully controlling the tolerances between each element of the nose assembly in order to maximize its rigidity. Although the nose assembly includes several threaded joints, these joints are not relied upon to provide radial support between the respective members interconnected along the joints. Rather, closely fitted coaxial members are radially supported via substantially continuous contact between smooth walled bores and smooth walled cylindrical members fitted within the bores.

The rigidity of the nose assembly is augmented by the inherent rigidity of the hydraulic or pneumatic tool to which the nose assembly is rotatably mounted. That is, pneumatic and hydraulic tools must be constructed with accurately dimensioned rigid sections for accommodating the large pressures generated during tool actuation. By closely fitting the rotatable nose assembly to the rigid tool, the rigidity of the tool may be transferred to the nose assembly to minimize its deflection during tool actuation.

In practice, it has been found that the useful life of the nose assembly has been increased by a factor of 10 to 20 times by reducing assembly tolerances and avoiding radial loading of threaded joints.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein.

DETAILED DESCRIPTION OF THE PREFERRED EMBODIMENTS

Figures 1, 2:
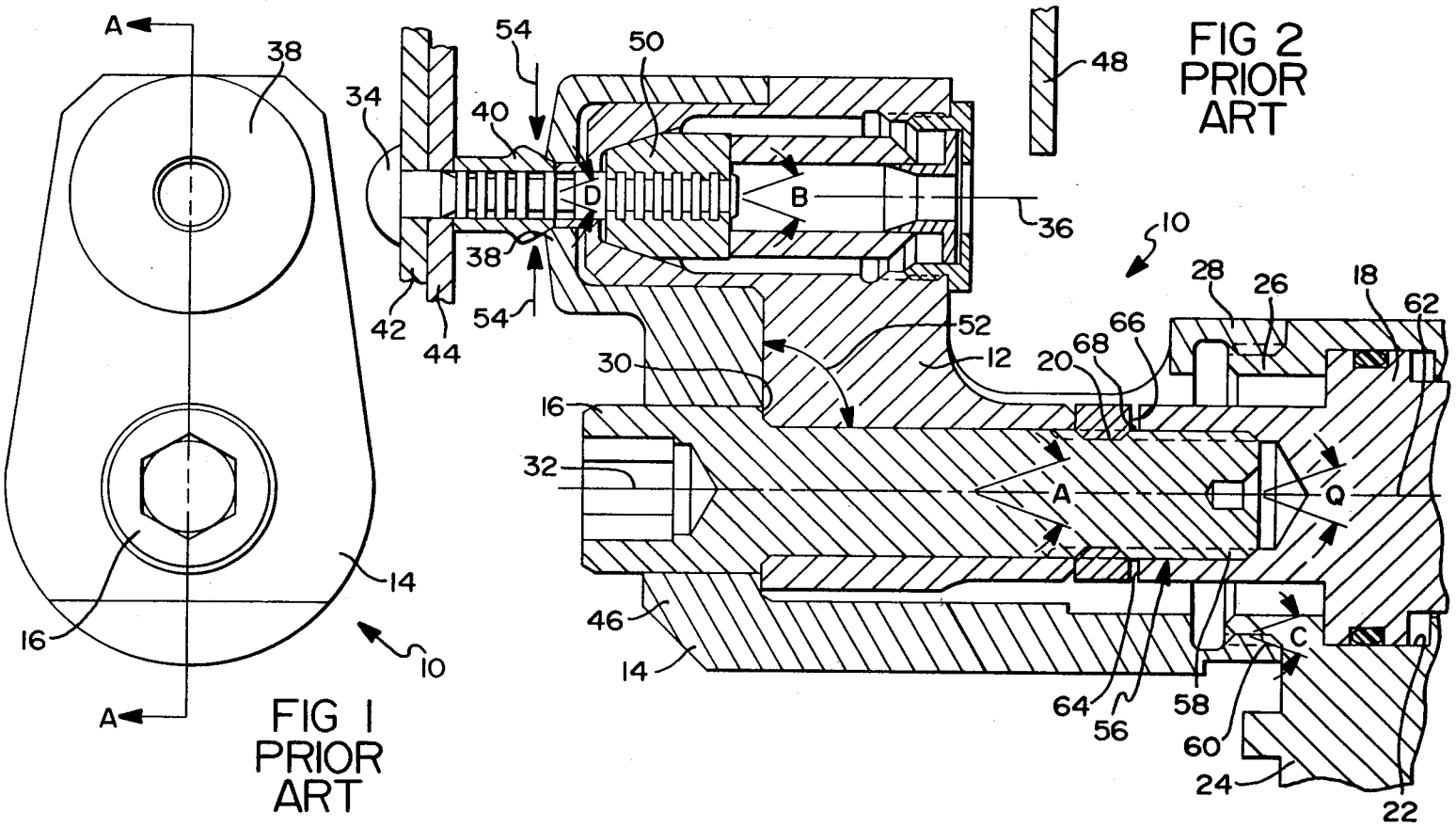
FIG 2 PRIOR ART
FIG 1 PRIOR ART
FIG. 1 is a front elevation view of a nose assembly according to the prior art.
FIG. 2 is a longitudinal sectional view through line A—A of FIG. 1.

In order to fully appreciate the advantages of the present invention, reference is initially made to a known offset nose assembly 10 shown in FIGS. 1 and 2. Collet member 12 is slidably nested within anvil housing 14 and guided therein via threaded drawbar 16 during tool actuation. The collet 12 is connected to a hydraulically powered reciprocating actuator such as piston 18 via threaded portion 20 of drawbar 16. The piston 18 is guided within a bore 22 formed within the body of installation tool 24 shown in fragment. A threaded boss 26 extending from the tool 24 is received within the internally threaded sleeve 28 of the anvil housing 14 to secure the anvil housing to the installation tool.

Upon actuation of piston 18, the stepped shoulder 30 of drawbar 16 axially pulls collet 12 along the axis of the piston in the direction of arrow 32 via stepped shoulder 30. The collet 12 is provided with a set of jaws 50 which grips and pulls pin 34 in the general direction indicated along pin axis 36, generates a reactionary force which causes the anvil 38 to abut collar 40 and swage the collar about the pin in a known fashion. In this manner a lockbolt connection is completed across the panel members 42 and 44. Because the anvil 38 is radially offset from the base portion 46 of the anvil housing 14 which surrounds the threaded drawbar 16, the nose assembly 10 may reach within the small clearance space defined between abutting panels 42 and 44 and panel member 48.

Since large forces are developed during swaging, any assembly tolerances within the offset nose assembly 10 located between the piston 18 and anvil 38 will allow the collet 12 and jaws 50 to rock, twist or cant within the anvil housing 14 such as indicated by directional arrows 52. Additional rocking or skewing may occur between the anvil housing 14 and the installation tool 24 particularly along the threaded joint between boss 26 and sleeve 28. This rocking or canting during swaging will result in the application of a radial load to the pin 34 as represented by arrows 54. As noted above, any radial force applied to the pin 34 is generally undesirable. Preferably, a pure axial pull along the axis 36 of the pin is desired.

As further seen in FIG. 2, a primary cause of deflection between the collet 12 and anvil housing 14 is the threaded fit 56 between the threaded portion 20 of the threaded drawbar 16 and the threaded portion 58 of piston 18 as well as the threaded fit 60 between the anvil housing 14 and the threaded boss 26 of installation tool 24. Prior assemblies such as shown in FIGS. 1 and 2 have specified a class two fit between the grooves and threads along these connections.

Such a fit specifies about a 0.020 inch total cumulative tolerance and allows the threaded drawbar 16 to wobble or shift about the axis 62 of the piston over an angle A. This shifting in turn causes the collet 12 to be pulled or shifted over angle B such that the axis of the jaws 50, which is preferably coaxial with the axis 36 of the pin 34, would be shifted over a substantially corresponding angle of deflection B. This results in the application of a radial load to the pin 34 and promotes premature and/or uncontrolled pin failure.

A similar deflection of the anvil housing 14 about the tool 24 is caused by the threaded interconnection 60 between boss 26 and sleeve 28. That is, the loose threaded fit between these members causes the anvil housing 14 to rock about the axis of the sleeve 28 through an angle C. This deflection is in turn transferred to the anvil 38 as represented by angle D, thereby exacerbating any other misalignment between the anvil 38 and collet 14. As the anvil 38 rocks about pin 34 through angle D, radial forces are transmitted to pin 34 causing the undesirable results noted previously. As it frequently turns out deflections A and B are additive and cause premature or uncontrolled pin failures.

Another problem associated with the conventional threaded interconnection 56 between the threaded drawbar 16 and piston 18 is the fracture of the threaded drawbar at the respective interfaces 64, 68 between the threaded drawbar and piston and the threaded drawbar and collet nut 68. As the stress at these points is concentrated due to the deflection and loading of the threads noted above, fracture and failure of the threaded drawbar at these points is not uncommon.

Figure 4:
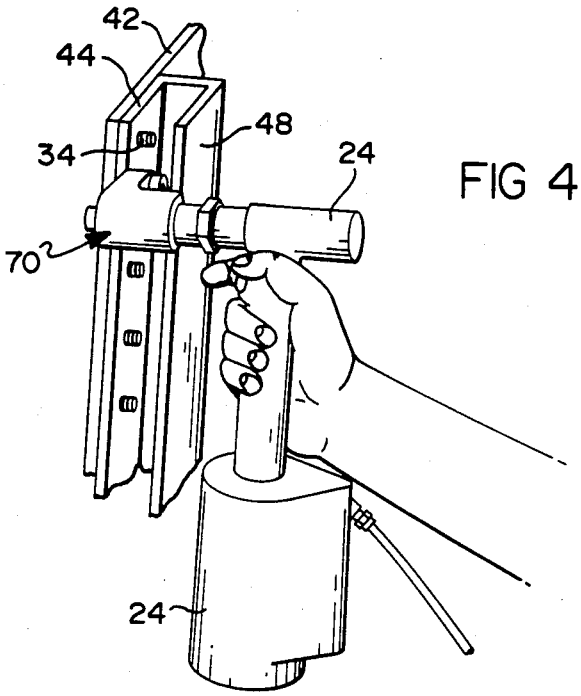
FIG. 4 is a schematic perspective view of the nose assembly of the present invention fitted to an installation tool and located adjacent a typical lockbolt installation site.
Figure 3:
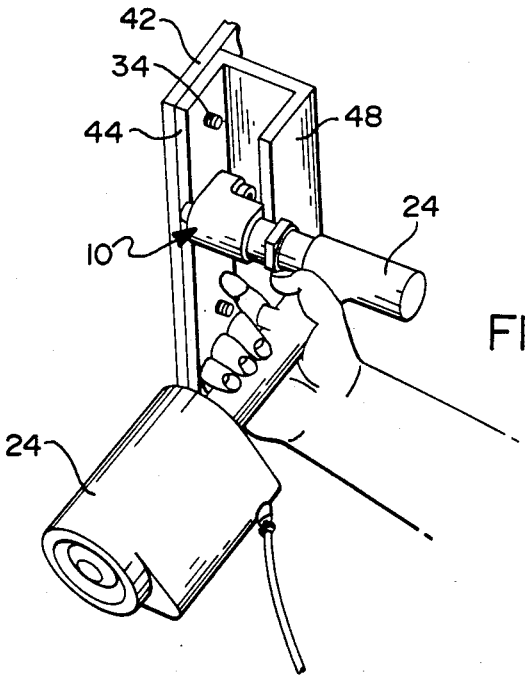
FIG. 3 is a schematic perspective view of tee nose assembly of FIGS. 1 and 2 fitted to an installation tool and located adjacent a typical lockbolt installation site.
Figure 5:
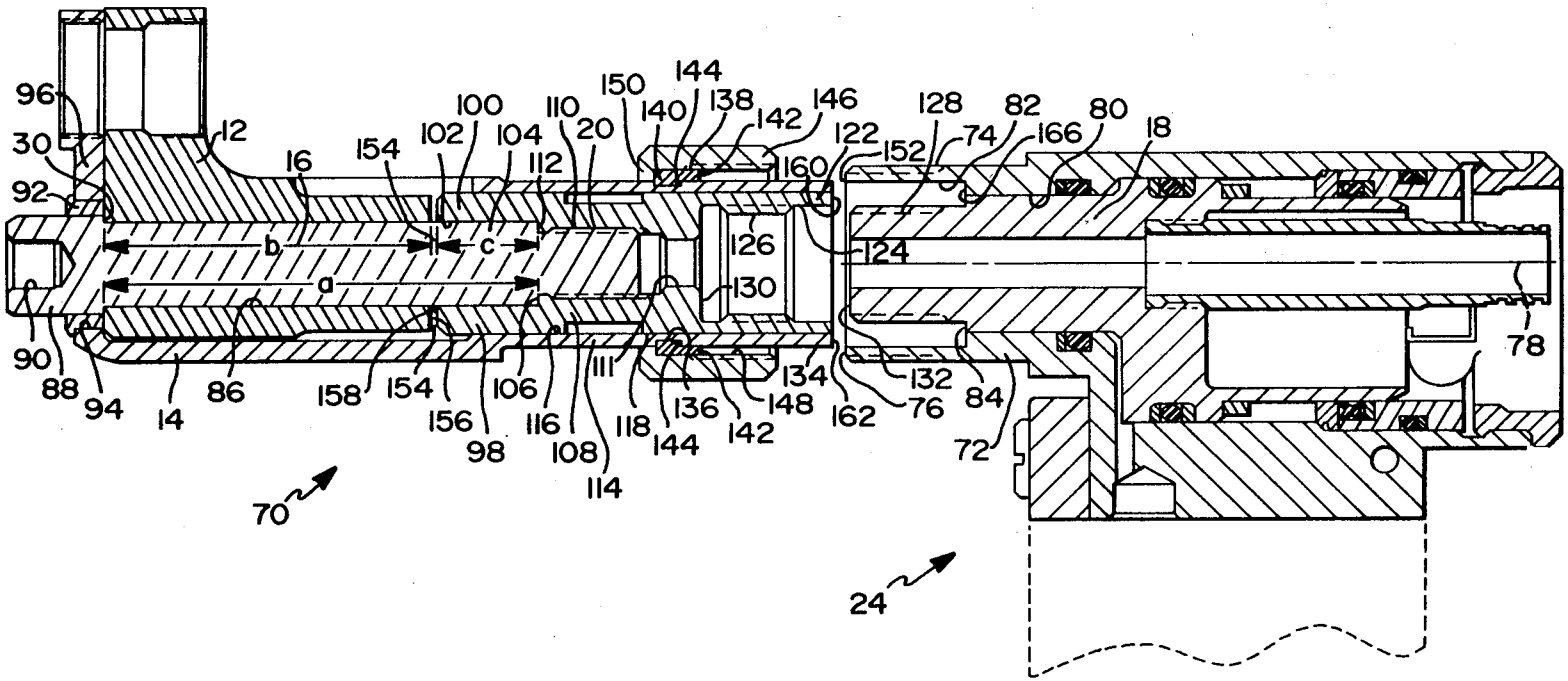
FIG. 5 is a central longitudinal sectional view through the nose assembly and installation tool of the present invention showing the relationship of the mating surfaces of the nose assembly and tool.
Figure 6:
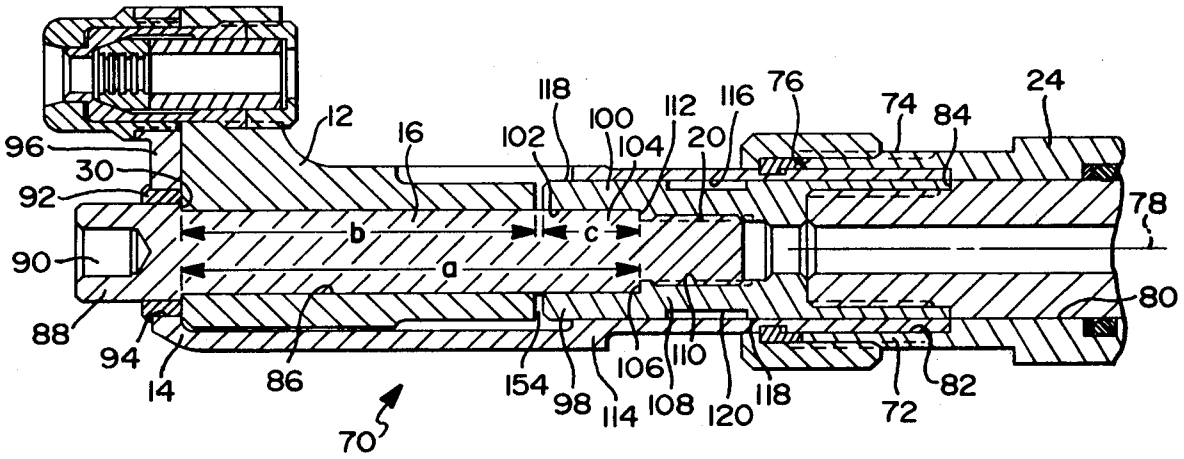
FIG. 6 is a longitudinal sectional view through line B—B of FIG. 7 showing a nose assembly according to the present invention and showing the rotatable interconnection between the nose assembly and installation tool body.
Figure 7:
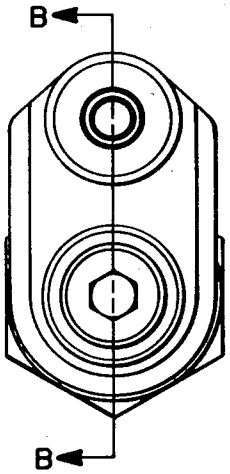
FIG. 7 is a front elevation view of the nose assembly of FIG. 6.

A comparison of the present invention with the prior art is shown in FIGS. 3 and 4 wherein lockbolt pins 34 are seen projecting through panels 42 and 44. Panel 44 is formed as a channel member having an exterior panel flange 48 which extends over the lockbolt pins 34. In order to access the lockbolt pins 34 with an installation tool 24 fitted with the prior art non-rotatable nose assembly 10, the operator must hold the tool in a generally horizontal plane as seen in FIG. 3. The operator must exert significant force and torque with a turned or twisted grip to hold the tool in this position and as a result rapidly experiences muscle fatigue.

With the same installation tool 24 fitted with the rotatable nose assembly 70 shown in FIG. 4 and discussed in detail below, the operator may hold the tool in a more comfortable vertical position without any turning or twisting of the hand and wrist. This is accomplished by rotating only the nose assembly 70 to access the lockbolt pin 34 rather than rotating the entire installation tool 24. The installation tool 24 is thus designed for maximum operator comfort under most applications so that operator fatigue is minimized and access to difficult to reach lockbolt pins is facilitated.

Referring now to FIGS. 5 through 9, the rotatable offset nose assembly 70 of the present invention is shown rotatably mounted to the body of installation tool 24. Tool 24 is formed with a tubular cylindrical sleeve 72 which is externally threaded at 74. Sleeve 72 terminates at end face 76 which is machined square within 0.002 inch to present a virtually flat surface aligned perpendicular to sleeve axis 78. The inner surface 80 of sleeve 72 is formed with a radially stepped cylindrical bore 82. Piston 18 is slidably fitted within sleeve 72 with an extremely close tolerance typically required for hydraulic piston and sleeve assemblies, i.e. 0.001 to 0.002 inch.

The surface of bore 82 is carefully machined with a 0.001 inch tolerance on its internal diameter. A radial abutment and alignment step 84 on piston 18 is machined square within 0.002 inch so that the plane in which step 84 lies cannot deviate more than 0.001 inch from a plane which is exactly perpendicular to sleeve axis 78. These tight tolerances are desired to minimize the application of radial loads to the fastener pins and to minimize radial loading along threaded joints within the nose assembly 70. However, these tolerances are only part of the solution. That is, the nose assembly 70 must also be accurately machined and dimensioned in a similar fashion to take advantage of the strength, rigidity and alignment surfaces provided by the sleeve 72 and piston 18.

Nose assembly 70 includes a collet 12 slidably nested within an anvil housing 14. A threaded drawbar 16 passes through an internal bore 86 formed in collet 12 with a total clearance fit of 0.0005 inch to 0.002 inch (0.00025 to 0.001 inch per diametral side). The head 88 of drawbar 16 is formed with an internal hexagonal socket 90 for assembly purposes and a stepped shoulder 30 for applying an axial pulling force on the collet 12. A tubular bushing 92 is pressed within a bore 94 formed within the front wall 96 of the anvil housing 14. Bushing 92 provides a bearing surface against which drawbar head 88 reciprocates during tool actuation.

Although the aft end of drawbar 16 is threaded at 20, these threads receive little if any radial loading because of the close fit of the drawbar within an adapter coupling 98. The front end 100 of adapter coupling 98 is formed with a smooth walled internal cylindrical bore 102 for receiving a smooth surfaced non-threaded cylindrical portion 104 of the aft end of drawbar 16 with a total clearance fit within 0.0005 inch to 0.002 inch.

This close fit prevents the drawbar from rocking within the adapter coupling and thereby reduces or eliminates any radial loading on the threads 20. Moreover, the corresponding close fit between the collet 12 and drawbar 16 further limits deflection within the nose assembly 70 as the drawbar is prevented from wobbling within the collet.

The adapter coupling 98 adapts the drawbar 16 to mate with tool 24. The rigidity of the tool 24 is transferred to the adapter coupling 98 which in turn provides rigid support to the drawbar 16 as well as to the anvil housing 14. This construction thereby offers the advantages of a rigid in-line nose assembly in an offset nose assembly and keeps deflections to a minimum.

Bore 102 terminates in a radial abutment step 106 which axially locates the drawbar 16 within the adapter coupling 98. A forward central portion 108 of adapter coupling 98 is formed with an internally threaded bore 110 for receiving the threaded end 20 of drawbar 16. During assembly, drawbar 16 is torqued down into bore 110 with an assembly tool fitted within socket 90 until shoulder 112 of drawbar 16 bottoms out and tightly abuts step 106. A hexagonal bore 111 is formed within the central portion of the adapter coupling 98 for engagement with an assembly tool inserted from the rear of the anvil housing to prevent the adapter coupling from rotating during its connection to the drawbar.

The aft end of anvil housing 14 is formed with a cylindrical tubular portion 114 having a smooth-walled internal cylindrical bore 116 which receives the adapter coupling 98 with a total clearance fit of no more than 0.004 inch. Almost the entire outer cylindrical surface 118 of adapter coupling 98 is closely supported within bore 116 to prevent the adapter coupling from rocking within the anvil housing 14. Again, the elimination of rocking movements within the nose assembly 70 is to prevent radial loading on the fastener pins and to ensure a virtually pure axial movement of the drawbar 16 and collet 12 within and with respect to the anvil housing 14.

Flat faces 120 may be machined in the outer surface 118 of the adapter coupling 98 for disassembly purposes in the event the drawbar prematurely unscrews from the adapter coupling during disassembly. That is, in the event the drawbar unscrews from the adapter coupling before the adapter coupling unscrews from the piston. The aft portion 122 of adapter coupling 98 is formed with an internal bore 124 having a threaded portion 126 for engaging an externally threaded portion 128 of piston 18 in order to connect the adapter coupling 98 to the piston. Bore 124 terminates at a radially stepped face 130 which is dimensioned to form a clearance fit with the end face 132 of piston 18. Because a clearance is designed between faces 130 and 132, these faces may be relatively roughly toleranced.

The outer surface 134 of tubular portion 114 of anvil housing 14 is carefully machined with a tolerance of 0.001 inch on its outer diameter to coaxially nest within bore 82 of sleeve 72 of tool 24 with a total diametral tolerance clearance of 0.002 inch. The "additional" radial tolerance of 0.001 inch arises from the previously noted tolerance of 0.001 inch on the inner diameter of bore 82 formed in sleeve 72. Surface 134 is further machined with an annular groove 136 having a rectangular axial cross section.

Figure 9:
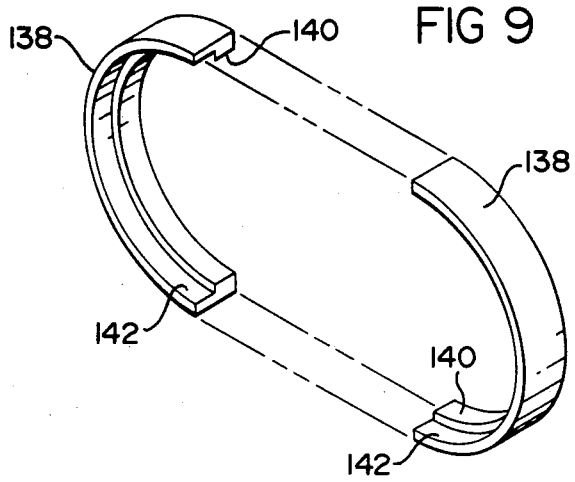
FIG. 9 is a perspective view of the split ring.
Figure 8:
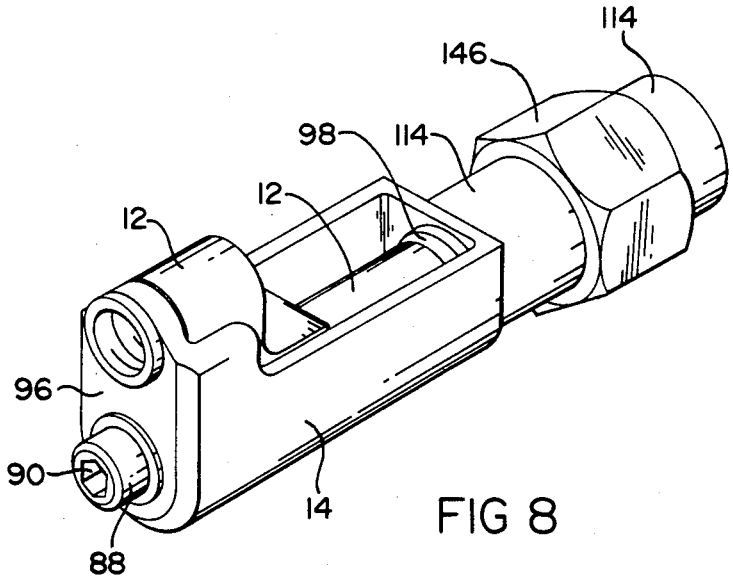
FIG. 8 is a perspective view of the nose assembly of FIGS. 5, 6 and 7.

Groove 136 is provided for receiving a two-piece annular split ring 138 shown in detail in FIG. 9. Split ring 138 is formed with a radially inwardly projecting rectangular step 140 which seats within groove 136 and an axially extending rectangular sleeve 142. The axial length of step 140 is dimensioned to allow a minimal axial clearance 144 between the step 140 and groove 136 of about 0.001 inch to 0.002 inch during the pulling stroke of the tool.

In effect, the split ring 138 acts as a spacer or stand-off which prevents the anvil housing from being non-rotatably clamped to the sleeve 72 by ensuring an axial clearance is formed therebetween. It is essential to provide for axial clearance 144 as this clearance allows the anvil housing 14 to rotate freely within sleeve 72 and around adapter coupling 98, as discussed further below.

A retaining nut 146 is internally threaded at 148 to engage the external threads 74 formed on sleeve 72. A radially inwardly projecting flange 150 is formed at one end of nut 146 to engage the split ring 138. As nut 146 is tightened, the end face 152 of sleeve 142 abuts the end face 76 of sleeve 72 so as to clamp the split ring therebetween while maintaining the necessary clearance 144 between step 140 and groove 136. End face 152 is machined square within 0.002 inch to accurately mate with end face 76. Clearance 144 is created by carefully locating and dimensioning the annular groove on the anvil housing and by carefully dimensioning the axial lengths of the step 140 and sleeve 142.

In order to ensure the rotatability of nose assembly 70, an additional clearance 154 must be maintained between the rear face 156 of the collet 12 and the front face 158 of the adapter coupling 98. This is achieved by designing drawbar dimension "a" (FIG. 5) greater than the sum of collet dimension "b" and adapter coupling dimension "c". Clearance 154 is preferably maintained within a range of 0.001 inch to 0.006 inch. This clearance ensures that the rotatable collet 12 will not abut the fixed adapter coupling 98, as abutment would interfere with the free rotation of the collet.

The nose assembly 70 may be installed on tool 24 by simply threading the adapter coupling 98 onto the piston 18 via threads 126 and 128 and snugly torquing the adapter coupling against the piston 18 with a suitable tool applied to socket 90. In this manner, end face 160 of the adapter coupling will squarely abut the alignment step 84 on the piston. End face 160 is machined square within 0.002 inch to complement the surface of step 84. This closely matched coaxial fit between the adapter coupling and piston provides significant support and alignment for the nose assembly and rigidly fixes and locks the adapter coupling to the tool.

At this point in the installation procedure the retaining nut 146 may be torqued down over threads 74 on sleeve 72 to complete the assembly. It should be noted that the end face 162 of the anvil housing 14 is allowed to axially "float" over the extent of clearance 144 such that end face 162 is not rotatably or axially restrained against step 166 formed within sleeve 72.

It can be appreciated that once the assembly is carried out as set forth above, the anvil housing 14 and collet 12 are freely rotatably mounted over the non-rotatable drawbar, and that the anvil housing is also rotatably mounted over the non-rotating adapter coupling and non-rotating piston. The anvil housing is thereby rotatably axially retained on the tool via the split ring and retainer nut. The close coaxial non-threaded nesting of the tubular portion 114 of the anvil housing and the aft portion 122 of the adapter coupling within bore 82 limits deflection of the nose assembly to a minimum during tool actuation, since a smooth-walled coaxial fit provides far greater accuracy in assembly than threaded joints.

Obviously numerous modifications and variations of the present invention are possible in light of the above teachings. It is therefore to be understood that within the scope of the appended claims, the invention may be practiced otherwise than as specifically described herein.

What is claimed is:

1. An offset nose assembly for swaging a fastener collar about a fastener pin, comprising:

an anvil housing;

a collet member operatively associated with said anvil housing;

a drawbar connected to said collet member for applying a pulling force to said collet member, said drawbar having a smooth-walled tubular portion; and an adapter coupling for connecting said nose assembly to an installation tool, said adapter coupling being operatively associated with said anvil housing and said adapter coupling having a smooth-walled internal bore formed therein, said smooth-walled bore of said adapter coupling receiving a rear portion of said smooth-walled tubular portion of said drawbar with a close fit for rigidly supporting said drawbar during tool actuation so as to limit deflection of said drawbar within said adapter coupling.

2. The assembly of claim 1, wherein said anvil housing is formed with a smooth-walled internal bore and wherein said adapter coupling is formed with a smooth-walled tubular surface portion close fitted within said smooth-walled internal bore of said anvil housing.

3. The assembly of claim 1, wherein said collet member is formed with a smooth-walled internal bore for receiving a front portion of said smooth-walled tubular portion of said drawbar with a close fit.

4. The assembly of claim 3, wherein an axial clearance is provided between said collet member and said adapter coupling for allowing said collet member to freely rotate around said drawbar.

5. The assembly of claim 1, further comprising a fastening member mounted over said anvil housing for mounting said nose assembly to said installation tool.

6. The assembly of claim 5, wherein said anvil housing is formed with an external annular groove and wherein said assembly further comprises a split ring member disposed within said annular groove and within said fastening member for abutting said installation tool and axially locating said anvil housing with respect to said installation tool.

* * * * *